US008646511B2

(12) United States Patent
Marra et al.

(10) Patent No.: US 8,646,511 B2
(45) Date of Patent: Feb. 11, 2014

(54) COMPONENT WITH INSPECTION-FACILITATING FEATURES

(75) Inventors: John J. Marra, Winter Springs, FL (US); Paul J. Zombo, Cocoa, FL (US)

(73) Assignee: Siemens Energy, Inc., Orlando, FL (US)

( * ) Notice: Subject to any disclaimer, the term of this patent is extended or adjusted under 35 U.S.C. 154(b) by 507 days.

(21) Appl. No.: 12/850,147

(22) Filed: Aug. 4, 2010

(65) Prior Publication Data

US 2012/0034097 A1 Feb. 9, 2012

(51) Int. Cl.
*B22D 46/00* (2006.01)
*F01D 5/14* (2006.01)

(52) U.S. Cl.
USPC ..... 164/150.1; 416/241 R

(58) Field of Classification Search
USPC ..... 164/4.1, 150.1; 416/241 R
See application file for complete search history.

(56) References Cited

U.S. PATENT DOCUMENTS 3,596,703 A 8/1971 Bishop et al.
4,358,882 A 11/1982 Wilkinson
7,134,475 B2 11/2006 Snyder et al.
8,066,052 B2 * 11/2011 Blair ..... 164/44
8,087,447 B2 * 1/2012 Propheter-Hinckley et al. ..... 164/132
8,287,183 B2 * 10/2012 Shepard et al. ..... 374/43
2008/0099178 A1 5/2008 Propheter-Hinckley et al.
2008/0292903 A1 * 11/2008 Milleville et al. ..... 428/680
2010/0014102 A1 1/2010 Blair

OTHER PUBLICATIONS

U.S. Appl. No. 12/794,972, filed Jun. 7, 2010.

* cited by examiner

*Primary Examiner* — Kevin P Kerns

(57) ABSTRACT

A turbine airfoil can be formed with features to facilitate measurement of its wall thickness. An outer wall of the airfoil can include an outer surface and an inner surface. The outer surface of the airfoil can have an outer inspection target surface, and the inner surface of the airfoil can have an inner inspection target surface. The inner and outer target surfaces can define substantially flat regions in surfaces that are otherwise highly contoured. The inner and outer inspection target surfaces can be substantially aligned with each other. The inner and outer target surfaces can be substantially parallel to each other. As a result of these arrangements, a highly accurate measurement of wall thickness can be obtained. In one embodiment, the outer inspection target surface can be defined by an innermost surface of a groove formed in the outer surface of the outer wall of the airfoil.

17 Claims, 5 Drawing Sheets

COMPONENT WITH INSPECTION-FACILITATING FEATURES

STATEMENT REGARDING FEDERALLY SPONSORED DEVELOPMENT

Development for this invention was supported in part by Contract No. DE-FC26-05NT-42644, awarded by the United States Department of Energy. Accordingly, the United States Government may have certain rights in this invention.

FIELD OF THE INVENTION

Aspects of the invention relate in general to hollow components and, more particularly, to the inspection of such components.

BACKGROUND OF THE INVENTION

Turbine airfoils, such as vanes and blades, are hollow components that include numerous internal features, such as cooling channels. Such airfoils and the internal features are typically made by investment casting using a core to form the desired internal features. The thickness of an outer wall of the airfoil can be critical to the component's performance during engine operation. The thickness of the outer wall of the airfoil must be kept within design specifications. Accordingly, once the airfoil is cast, the thickness of the outer wall is measured to ensure that it is within acceptable tolerances.

However, obtaining an accurate measurement of the thickness of the outer wall may be difficult if the outer surface and/or the inner surface of the outer wall is contoured at the point of measurement, as is typically the case with turbine airfoils. In such case, error is introduced into the wall thickness measurement. Such error can be problematic, particularly if subsequent machining or other manufacturing operations are dependent on the accuracy of the measured the wall thickness. Consequently, an undesirably high correction factor may need to be accounted for in the design, thereby preventing the component from achieving its full performance potential.

Thus, there is a need for a system and method for more precisely measuring the wall thickness of a component.

SUMMARY OF THE INVENTION

In one respect, embodiments of the invention are directed to a component, which can be, for example, a turbine engine component such as an airfoil. The component includes an outer wall having an outer surface and an inner surface. The outer surface and/or the inner surface of the outer wall can be contoured and can include a contoured region.

The outer surface includes a first outer inspection target surface. The first outer inspection target surface is substantially flat. The inner surface includes a first inner inspection target surface. The first inner inspection target surface is substantially flat. The first outer inspection target surface and/or the first inner inspection target surface are adjacent to the contoured region of a respective one of the inner and outer surfaces.

The first inner inspection target surface is substantially aligned with the first outer inspection target surface. The first outer inspection target surface is substantially parallel to the first inner inspection target surface. As a result, an accurate measurement of the thickness of the outer wall can be obtained at the location of the aligned inner and outer inspection target surfaces.

The outer inspection target surface can be defined by a portion of an innermost surface of a groove formed in the outer surface of the outer wall of the component. The groove can have opposing sidewalls. The innermost surface of the groove can be substantially perpendicular to one or both of the side walls. The innermost surface of the groove can be non-perpendicular to one or both of the side walls.

The component can include a second inner inspection target surface on the inner surface of the outer wall. The second inner inspection target surface can be spaced from the first inner inspection target surface. In one embodiment, the second inner inspection target surface can be aligned with the first outer inspection target surface. In such case, the first outer inspection target surface can be substantially parallel to the second inner inspection target surface. In another embodiment, the second inner inspection target surface can be aligned with a second outer inspection target surface. In such case, the second outer inspection target surface can be substantially parallel to the second inner inspection target surface. The second inner inspection target surface can be different from the first inner inspection target surface in size and/or shape.

In another respect, embodiments of the invention are directed to a method of measuring the thickness of a component. The method involves forming a component with an outer wall having an outer surface and an inner surface. The outer surface and/or the inner surface of the outer wall can be contoured and can include a contoured region. In one embodiment, the component can be formed by casting. The component can be a turbine engine component. More particularly, the turbine engine component can be an airfoil.

The outer surface includes an outer inspection target surface. The outer inspection target surface is substantially flat. The inner surface includes a first inner inspection target surface. The first inner inspection target surface is substantially flat. The first outer inspection target surface and/or the first inner inspection target surface are adjacent to the contoured region of a respective one of the inner and outer surfaces.

The first inner inspection target surface is substantially aligned with the outer inspection target surface. The outer inspection target surface is substantially parallel to the first inner inspection target surface. When the component is formed by casting, the method can include the step of providing a casting core that has a target forming surface on an outer surface thereof. The target forming surface can be substantially flat so as to form the inner inspection target surface.

The method also includes the step of measuring the thickness of the wall at the location of the aligned inner and outer inspection target surfaces. The measuring step is performed by eddy current, ultrasound or computed tomography.

In one embodiment, the outer inspection target surface can be defined by a portion of an innermost surface of a groove formed in the outer surface of the outer wall of the component. The groove can include opposing sidewalls. The innermost surface of the groove can be substantially perpendicular to at least one of the side walls. The innermost surface of the groove can be non-perpendicular to at least one of the side walls. After the measuring step, the method can further include the step of reducing at least a portion of the outer surface of the outer wall so as to be substantially flush with the innermost surface of the groove.

DETAILED DESCRIPTION OF EMBODIMENTS OF THE INVENTION

Embodiments of the invention are directed to a system and method for inspecting a component. Aspects of the invention will be explained in connection with an airfoil for a turbine engine, but the detailed description is intended only as exemplary. Indeed, it will be appreciated that aspects of the invention can be applied to other turbine engine components as well as in other applications in which the wall thickness of the component must be accurately measured. Embodiments of the invention are shown in FIGS. 1-6, but the present invention is not limited to the illustrated structure or application.

Figure 1:
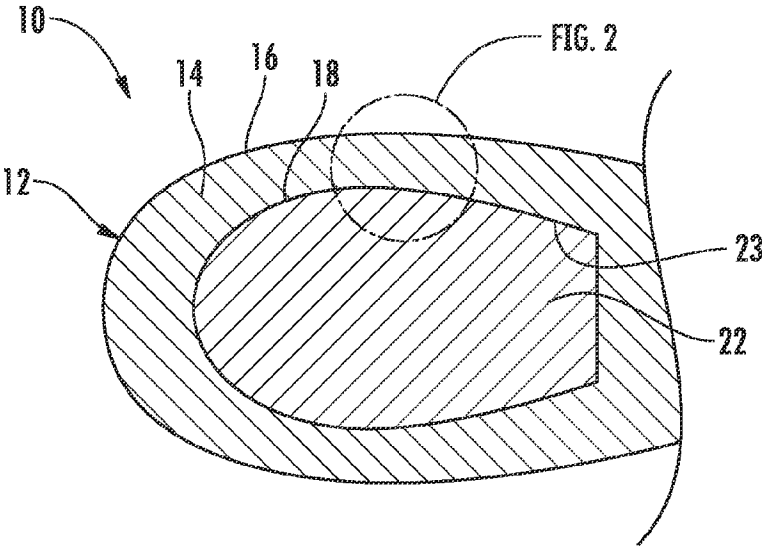
FIG. 1 is a top plan cross-sectional view of a cast turbine airfoil, showing a core forming internal features of the airfoil.

Referring the FIG. 1, a component 10 is shown. In one embodiment, the component 10 can be a turbine airfoil 12, which can be a blade or a vane. The airfoil 12 can be hollow and can have an outer wall 14. The outer wall 14 can include an outer surface 16 and an inner surface 18. At least a portion of the inner surface 18 and/or the outer surface 16 can be contoured and can define an associated contoured region. The contoured region can be substantially non-planar including curves and/or compound surfaces. The airfoil 12 can be formed using any suitable process. For instance, the airfoil 12 can be formed by casting. While the following description will be directed to embodiments in which the airfoil 12 is formed by casting, it will be understood that aspects of the invention are not limited to components formed by casting.

Figure 2:
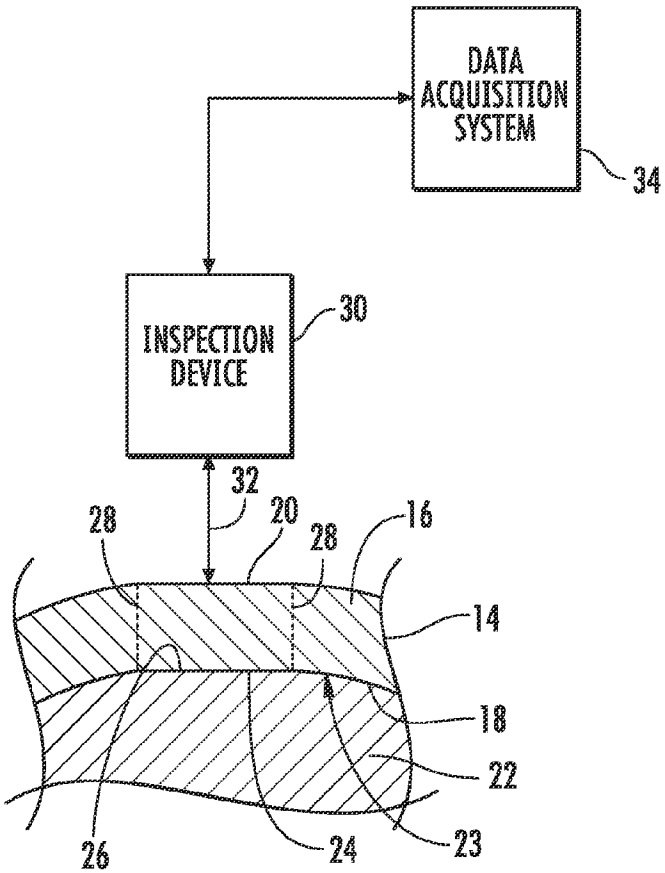
FIG. 2 is a cross-sectional view of a portion of the cast turbine airfoil of FIG. 1, showing an inner inspection target surface formed in an outer wall of the airfoil being substantially parallel to an outer inspection target surface formed in an outer surface of the outer wall.

During the casting process, the outer surface 16 can be formed by at least one die, mold, pattern or shell. At least a portion of the outer surface 16 of the airfoil 12 can be highly contoured, that is, it can be substantially non-planar including curves and/or compound surfaces. The outer surface 16 of the airfoil 12 can include at least one outer inspection target surface 20, as is shown in FIG. 2. The outer inspection target surface 20 can be substantially flat. "Substantially flat" means all points of the outer inspection target surface 20 can lie in the same plane or one or more points can slightly deviate therefrom. The outer inspection target surface 20 can have any suitable size and/or shape. The outer inspection target surface 20 can be formed by a corresponding substantially flat feature in the die, mold, pattern or shell.

The inner surface 18 and/or other internal features of the airfoil 12 can be formed by one or more cores 22, one of which is shown in FIG. 1. The core 22 can be formed in any suitable manner. The core 22 can have an outer surface 23.

Referring to FIG. 2, the core 22 can include one or more target forming surfaces 24 on an outer surface 23 of the core 22 to form corresponding inner inspection target surfaces 26 on the inner surface 18 of the outer wall 14 of the airfoil 12. The target forming surfaces 24 and the inner inspection target surfaces 26 can have any suitable size, shape and configuration. The target forming surfaces 24 and/or the inner inspection target surface 26 can have a predetermined size so that the inspection equipment can be calibrated based on that predetermined size. For instance, the measured size of the target forming surface 24 and/or the inner inspection target surface 26 after the component has been cast can be compared to the known size of the target forming surface 24, which may have been measured prior to casting. Any differences in the measurement can be taken into account as a correction factor in any post-casting measurement.

The target forming surface 24 and the inner inspection target surface 26 can be substantially flat. That is, for each inner inspection target surface 26 and each target forming surface 24, all points of the surface can lie in the same plane, or there can be slight deviations therefrom. The target forming surfaces 24 and the inner inspection target surfaces 26 can be discrete local features. Accordingly, the target forming surfaces 24 and the inner inspection target surfaces 26 can be designed to minimize local stress concentrations and to avoid any requirement of an increase in thickness of the outer wall 14 of the airfoil 12. In some instances, the target forming surfaces 24 and the inner inspection target surfaces 26 can be relatively small. For instance, the target forming surfaces 24 and the inner inspection target surfaces 26 can be circular from about 1 to about 2 millimeters in diameter.

There can be any suitable quantity of target forming surfaces 24 and inner inspection target surfaces 26. In one embodiment, there can be a single target forming surface 24 and a single inner inspection target surface 26. In other embodiments, there can be a plurality of target forming surfaces 24 and the inner inspection target surfaces 26. In the case of a plurality of inner inspection target surfaces 26, the inner inspection target surfaces 26 can be substantially identical to each other. Alternatively, at least one of the inner inspection target surfaces 26 can be different from the other inner inspection target surfaces 26 in one or more respects, including, for example, in size, shape and orientation. When the inner inspection target surfaces 26 are different, each of the inner inspection target surface 26 can represent a unique identifier that can facilitate the inspection process. It will be appreciated that the above discussion concerning the inner inspection target surfaces 26 can apply equally to the target forming surfaces 24 as well as the outer inspection target surfaces 20.

Figure 6:
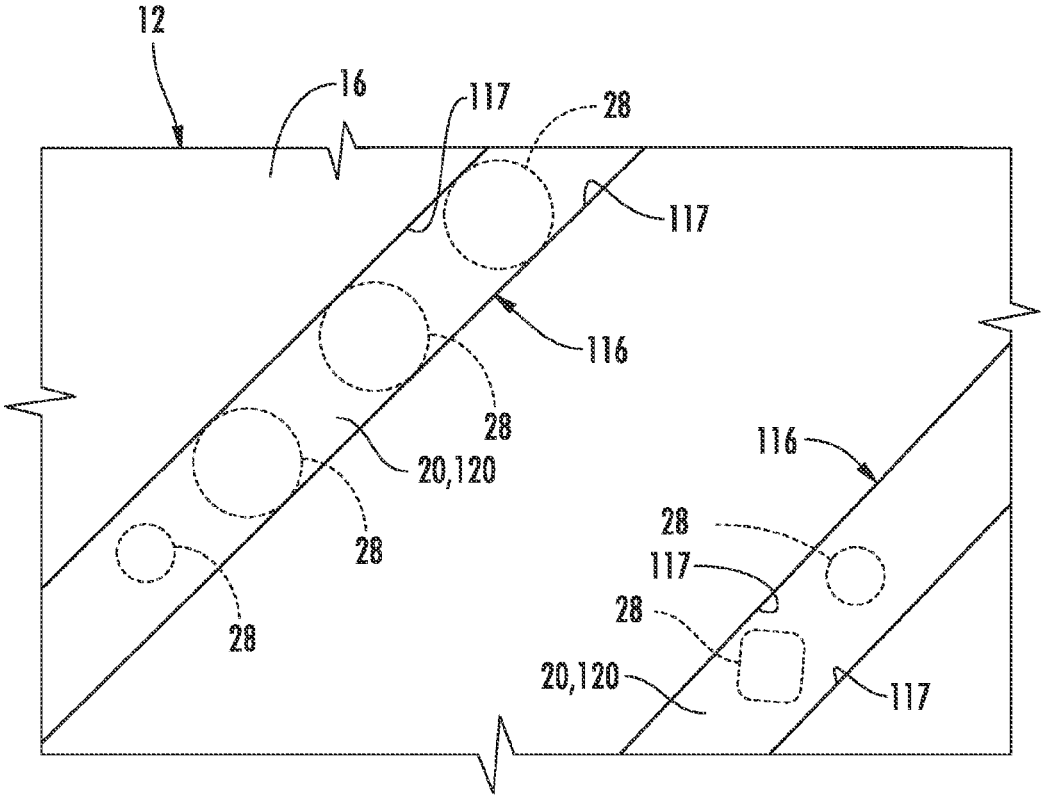
FIG. 6 is a side elevation close up view of a portion of a groove formed in an outer wall of the turbine airfoil, showing a plurality of inspection target surfaces on an inner surface of the outer wall that are aligned with the innermost surface of the groove.

Further, in the case of a plurality of target forming surfaces 24 and the inner inspection target surfaces 26, the target forming surfaces 24 can be provided in any suitable manner on the core 22, and the inner inspection target surfaces 26 can be provided in any suitable manner on the inner surface 18 of the outer wall 14 of the component 10. For instance, the target forming surfaces 24 can be aligned on the core 22, and the inner inspection target surfaces 26 can be aligned on the inner surface 18 of the outer wall 14, as is shown in FIG. 6. In such cases, the target forming surfaces 24 and the inner inspection target surfaces 26 can be provided at a substantially equal or unequal spacing. In one embodiment, the target forming surfaces 24 and the inner inspection target surfaces 26 may not be arranged in any particular relationship to each other.

Once it is completed, the core 22 can be used in casting the ultimate component. In the case of an airfoil, such casting can be done by investment casting. In such case, wax can be injected onto the core 22 so that the core 22 is covered by wax. A ceramic shell can be formed over the wax. The wax can be melted out and molten metal can be poured in the space between the core 22 and the ceramic shell. Once the metal solidifies, the core 22 can be chemically leached out of the casting, leaving the desired internal features in the vane or blade. In the investment casting process, the core 22 is used only one time.

The core 22 can be arranged in the mold or die such that the target forming surfaces 24 are substantially aligned with predetermined portions of the shell, mold or die such that, when the part is formed, each inner inspection target surface 26 formed on the inner surface 18 of the outer wall 14 is substantially aligned with an outer inspection target surface 20 on the outer surface 16 of the outer wall 14. The term "substantially aligned" means that if an imaginary projection 28 of the inner inspection target surface 26 was superimposed onto the outer surface 16 of the outer wall 14 of the component 10, then at least a substantial portion of the imaginary projection 28 can overlap the outer inspection target surface 20. In one embodiment, the entire imaginary projection 28 can overlap the outer inspection target surface 20. According to aspects of the invention, the substantially aligned inner and outer inspection target surfaces 26, 20 can be substantially parallel to each other. The term "substantially parallel" means true parallel and slight deviations therefrom.

The outer inspection target surface 20 can be adjacent to a contoured region of the outer surface 16 of the outer wall 14. Alternatively or in addition, the inner inspection target surface 26 can be adjacent to a contoured region of the inner surface 18 of the outer wall 14. The term "adjacent" can include a portion of the inner and/or outer inspection target surfaces 20 being located at an edge of a contoured region and/or at a transition between a contoured region and a flat region. The term "adjacent" can also include the inner and/or outer inspection target surface 20 being partially or completely surrounded by one or more contoured surfaces.

For each inner inspection target surface 26, there can be an associated outer inspection target surface 20. In one embodiment, one inner inspection target surface 26 can be associated with a single dedicated outer inspection target surface 20. Alternatively, a plurality of inner inspection target surfaces 26 can be associated with a single outer inspection target surface 20, which can be, for example, an elongated substantially flat surface or a relatively large substantially flat region. Still alternatively, a plurality of outer inspection target surfaces 20 can be associated with a single inner inspection target surface 26, which can be, for example, an elongated substantially flat surface or a relatively large substantially flat region.

During inspection of the component 10, the outer inspection target surface 20 and/or inner inspection target surface 26 can be identified. An inspection device 30, such as an ultrasound, computed tomography, or eddy current probe, can send an inspection signal 32 to the aligned outer and inner inspection target surfaces 20, 26. The inspection signal 32 can be substantially perpendicular to both of the aligned outer and inner inspection target surfaces 20, 26. The inspection signal 32 can reflect back to the inspection device 30, which can be operatively connected to a data acquisition system 34. The thickness of the component 10 can be determined in any suitable manner using information collected by the inspection device 30. It will be appreciated that an accurate measurement of the thickness of the outer wall 14 can be obtained because the inner and outer inspection target surfaces 26, 20 are substantially parallel.

It will be appreciated that aspects of the invention can provide numerous benefits. Aspects of the invention can be implemented to yield a highly accurate measurement of wall thickness. As a result, the thickness across the entire component 10 does not need to be measured. Instead, less than 100 percent of the wall thickness of the component 10 can be measured, but, due to the accuracy of the measurement described herein, it can be just as effective. Naturally, time and cost savings can be realized. Reduction in the amount of error or uncertainty in the measurement will allow less uncertainty to be factored into the design, thereby allowing designs that can achieve improved performance. Further, because the size of the outer and inner inspection target surfaces 20, 26 is known beforehand, a calibrated response to inspection of wall thickness can be provided, further improving accuracy.

Aspects of the invention can be used in connection with a variety of components. One example of the use will now be explained in connection with one particular process of forming an airfoil. Turbine airfoil walls are load bearing in which the cumulative centrifugal loading of the airfoil is carried radially inward via the outermost wall. As such, the thickness required at the tip of the airfoil determines the thickness at the root of the airfoil. Typical turbine airfoils have increasing cross-sectional areas moving from the tip to the root. The tip thickness is determined by casting tolerances that include allowances for variation in wall thickness plus the potential for internal cores to shift during the casting process. While simply designing an appropriate tip thickness and increasing the tip thickness to the root is feasible for small turbine airfoils, such is not the case for large airfoils useful in large turbine engines. In particular, when this design is scaled up to the larger engines, the root becomes larger than can be accommodated. In addition, the larger sized airfoil requires a part span snubber or tip shroud for vibration control, both of which become more difficult to manufacture with the large sized hollow components. Thus, an alternative configuration for a turbine airfoil is needed that is capable of being scaled up in size to without encountering the limitations of conventional cast airfoils.

Figure 3:
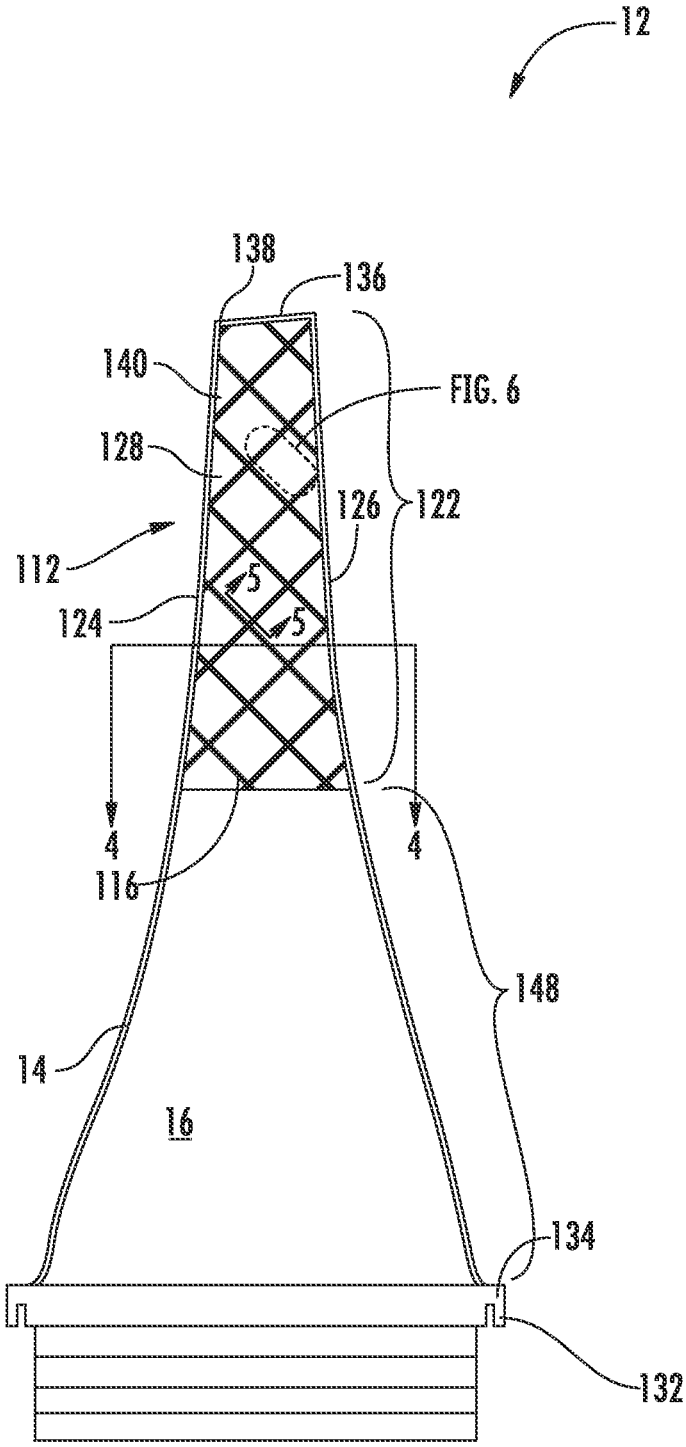
FIG. 3 is a side elevation view of an embodiment of a turbine airfoil in which aspects of the invention can be applied.
Figure 4:
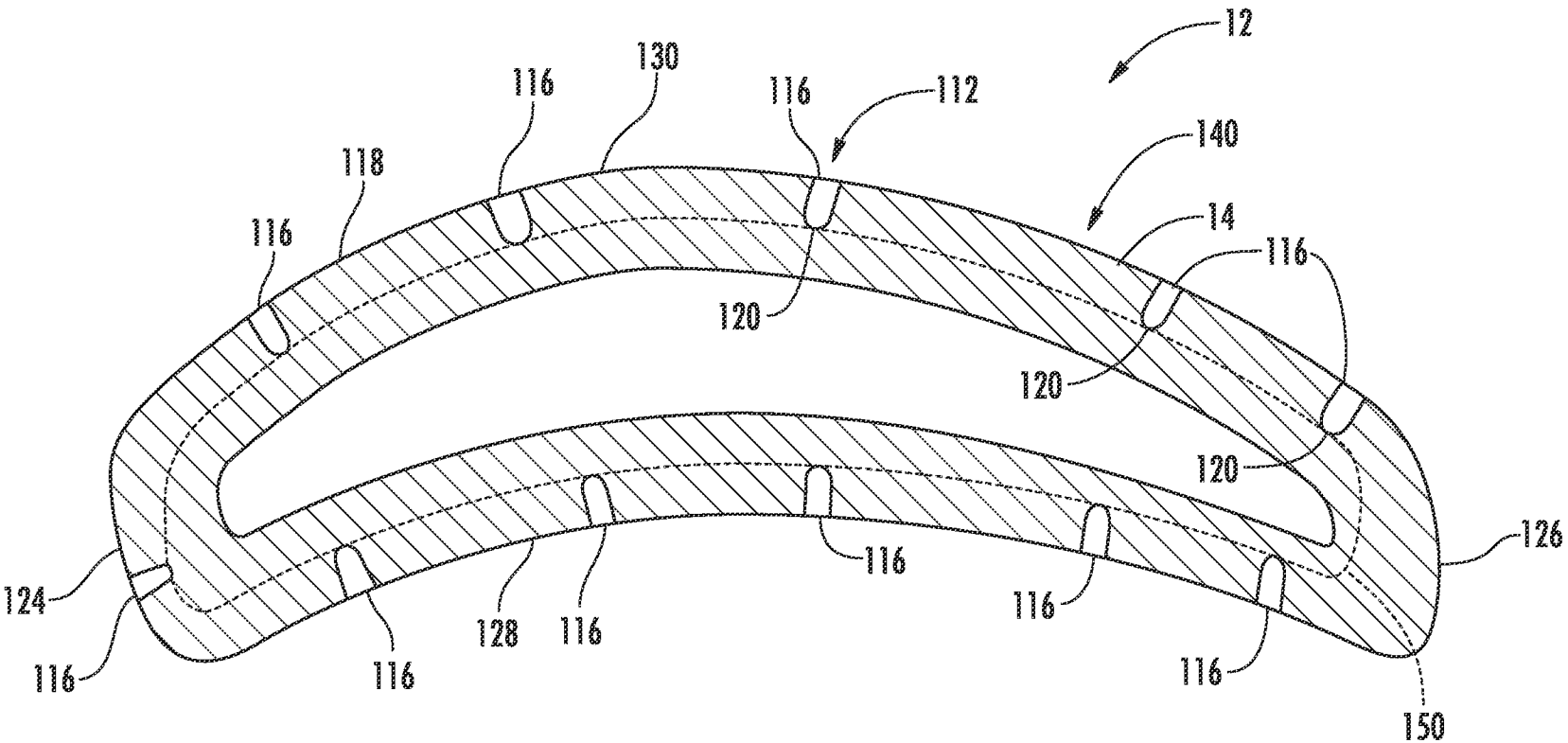
FIG. 4 is a cross-sectional view of the turbine airfoil taken along section line 4-4 in FIG. 3.

One example of such a configuration and method is disclosed in co-pending U.S. patent application Ser. No. 12/794,972, and aspects of the invention can be readily applied to the described configuration and method. Referring to FIG. 3, a turbine airfoil 12 usable in a turbine engine can include a depth indicator 112 for determining outer wall thickness. In FIGS. 3-6, some of the reference numbers are identical to those used previously when like elements and features are referred to. The turbine airfoil 12 may include an outer wall 14 having a plurality of grooves 116, as shown in FIGS. 3-4, in an outer surface 16 of the outer wall 14. The grooves 116 may have a depth that represents a desired outer surface 16 and wall thickness of the outer wall 14. The grooves 116 can have side walls 117 and an innermost point or surface 120. The term "innermost" is used relative to the inner surface 18 of the outer wall 14 of the airfoil 12.

The material forming the outer surface 16 of the outer wall 14 may be removed to be substantially flush with an innermost point or surface 120 in each groove 116, thereby reducing the wall thickness and increasing structural efficiency. The plurality of grooves 116 may be provided in a radially outer region 122 of the airfoil 12 proximate to a tip 136. The configuration of the outer region 122 can enable the outer wall 14 to be thinner than thicknesses of conventional airfoil walls in this region. Such configuration enables the outer region 122 to be sized without excess material often included with casting methods that have minimum thickness dimensions based on process limitations. The outer region 122 may include that area of the turbine airfoil 12 in which the thickness of the outer wall 14 is greater after being cast than required by stress loads, such as, but not limited to, centrifugal loads, developed during use. Forming the outer region 122 in this manner enables turbine airfoils 12 to be formed in larger sizes than conventional configurations without creating centrifugal loading problems during turbine engine operation.

As shown in FIG. 3, the turbine airfoil 12 may be a generally elongated hollow airfoil 140 formed from an outer wall 14. The generally elongated hollow airfoil 140 may have a leading edge 124, a trailing edge 126, a pressure side 128, a suction side 130, a root 132 at a first end 134 of the airfoil 140 and a tip 136 at a second end 138 opposite to the first end 134. The generally elongated hollow airfoil 140 may have any appropriate configuration and may be formed from any appropriate material. The turbine airfoil 10 may include a cooling system positioned within interior aspects of the generally elongated hollow airfoil 140. The cooling system may be positioned in the generally elongated hollow airfoil 140 and may have any appropriate cross-sectional shape.

The turbine airfoil 12 may include one or more grooves 116 in the outer surface 16 of the outer wall 14. The groove 116 in the outer wall 14 may have a depth that represents a desired outer surface and wall thickness of the outer wall 14. The grooves 116 may be formed during the manufacturing process, such as, but not limited to, a casting process, such that after being cast, the turbine airfoil 12 includes grooves 116 in the outer surface 16 of the airfoil 12. The grooves 116 may be used as visual guides for removing material to reduce the thickness of the outer wall 14. The material may be removed by any appropriate method such that the thickness of the outer wall 14 may be reduced such that the outer surface 16 of the outer wall 14 is substantially flush with the innermost point or surface 120 of each groove 116 to form a finished outer peripheral surface 150, as shown in FIG. 4.

The grooves 116 may be provided within an outer region 122 of the airfoil 12. The outer region 122 is that area of the airfoil 12 in which the thickness of the outer wall 14 after being cast is greater than required by stress loading during use. Thus, it is possibly to reduce the thickness of the outer wall 14 within the outer region 122 without jeopardizing the structural integrity of the airfoil 12. The outer region 122 may be formed, in one embodiment, from a radially outer 50 percent of a distance from the root 132 to the tip 136. The outer region 122 may include one or more grooves 116, and, in at least one embodiment, may include a plurality of grooves 116. One or more of the grooves 116 may be aligned. A portion of the plurality of grooves 116 in the outer surface 16 of the outer wall 14 may be aligned in a first direction and a portion of the plurality of grooves 116 in the outer surface 16 of the outer wall 14 may be aligned in a second direction that differs from the first direction. In at least one embodiment, the portion of the plurality of grooves 116 aligned in the first direction may be generally orthogonal to the plurality of grooves 116 aligned in the second direction. As such, the grooves 116 may form a generally crosshatched configuration of the outer surface 16 of the grooves 116.

The depth of the groove 116 may be determined by the desired thickness of the outer wall 14. In at least one embodiment, the depth of the groove 116 may be such that an innermost portion 120 of the groove 116 yields a thickness of the outer wall 14 between about one millimeter at the tip 136 of the generally elongated airfoil 140 and between 2.3 and 2.8 millimeters at an intersection with a portion of the turbine airfoil without a groove 116, such as the area of the airfoil 12 outside of the outer region 122. The outer wall 14 may have a thickness that is a reducing taper extending radially outward such that the thickness of the outer wall 14 at the tip 136 is less than the thickness of the outer wall 14 at the root 132. The outer wall 14 may have a thickness that is a linear reducing taper extending radially outward. In another embodiment, the outer wall 14 may have a thickness that is a nonlinear reducing taper extending radially outward.

The grooves 116 may be configured such that an innermost point or surface 120 of each groove 116 is indicative of a location of an outer surface 16 of the outer wall 14 after machining and is less than conventional thickness and greater than a minimum thickness of an airfoil. The thickness of the airfoil at the innermost point or surface 120 of each groove 116 may be equal to a calculated minimum thickness of the airfoil at the intersection between the outer region 122 and the inner region 148 of the airfoil 12. The outer wall 14 may be recontoured from this point radially inward to the root 132 to form a finished outer peripheral surface 150 of the airfoil 12.

The airfoil 12 may be formed from any appropriate method. In at least one embodiment, the airfoil 12 may be formed by investment casting. The hollow cooling passages may be defined using a ceramic casting core. The airfoil shape may be defined using wax. A plurality of raised lines may be created on an outer surface of wax. A flowable material that can solidify may be used to form a mold in the shelling portion of the investment casting process. The mold may include one or more chambers formed from a wall that is configured to form a generally elongated airfoil 140 formed from an outer wall 14.

After the flowable material has hardened, the wax is removed, and the mold may be filled with molten metal, thereby producing the generally elongated airfoil 140 with one or more grooves 116 in the outer wall 14 having a depth that represents a desired outer surface 16 and wall thickness of the outer wall 14 of the generally elongated airfoil 140. Pouring the molten metal into the mold cavity during the casting process enables molten metal to flow up against the ridges in the mold, thereby producing the grooves 116 in the outer surface 16 of the outer wall 14.

The grooves 116 can provide an immediate post-cast visual reference of the required amount of material removal needed from the tip 136 inward. The grooves 116 also provide an immediate visual indication of major core shifts which break through the grooves 116. Review of this visual indication is an important quality control check. In-situ wall thickness measurement may be improved by measuring a thickness at the bottom of the grooves 116. Because the internal casting cores cannot instantly shift position between grooves 116, this series of wall thickness measurements can effectively define the core position in the internal space of the airfoil casting.

Figure 5:
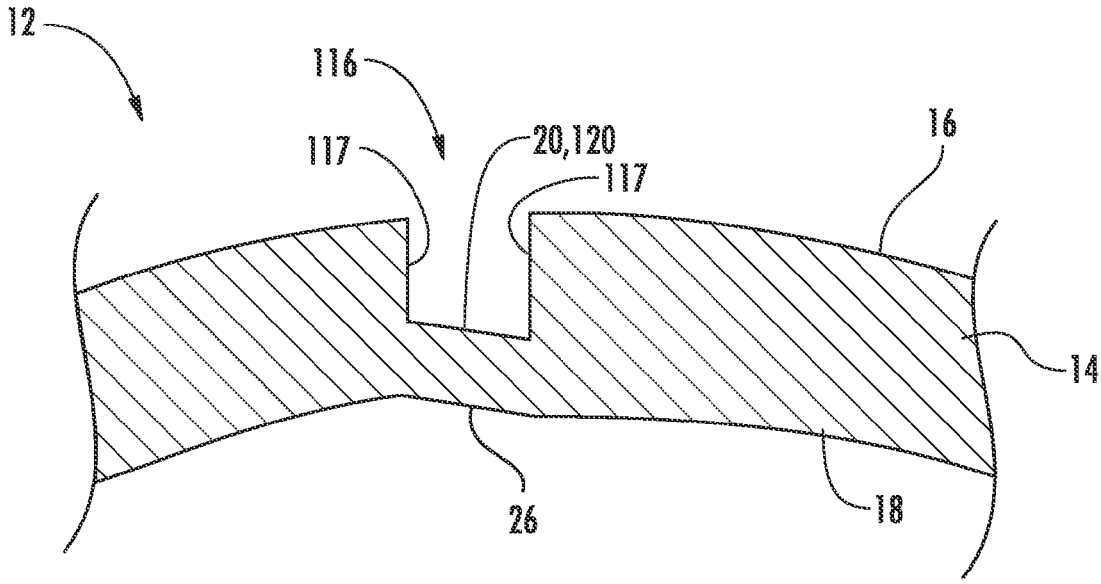
FIG. 5 is a cross-sectional view of a turbine airfoil taken along line 5-5 in FIG. 3, showing a groove having side walls that are non-perpendicular to an innermost surface of the groove.

The innermost point or surface 120 of each groove 116 can be substantially flat. At least a portion of the innermost point or surface 120 of each groove can form one or more of the outer inspection target surfaces 20. The innermost point or surface 120 can extend at any suitable angle relative to the side walls 117 of the groove 116. For instance, the innermost point or surface 120 can be substantially perpendicular to the side walls 117 of the groove 116. Alternatively, the innermost point or surface 120 of a groove 116 may be non-perpendicular to the side walls 117 of the groove 116, as is shown in FIG. 5

The inner inspection target surface 26 can be substantially parallel to the innermost surface 120 of the groove 116, which defines the outer inspection target surface 20. The thickness of the outer wall 14 can be measured at each point of overlap between the inner and outer inspection target surfaces 20, 26. Any suitable measurement device can be used, including an ultrasound probe, eddy current probe, or computed tomography just to name a few possibilities. Once the desired thickness is confirmed, the airfoil 12 can be machined to the desired depth, as defined by the grooves 116. In this particular design, it will be appreciated that a system according to aspects of the invention can reduce uncertainties in the measurement of the thickness of the outer wall. As a result, the wall thickness can be made thinner than what could otherwise be achieved.

Once the measurement process is completed, the outer surface 16 of the outer wall 14 may be reduced to being substantially flush with innermost points or surfaces 120 of the grooves 116 to form the outer peripheral surface 150 of the airfoil 12. In at least one embodiment, the outer surface 16 may be machined with processes, such as, but not limited to, electrochemical milling (ECM) or conventional milling. A small step, such as about 0.05 to 0.1 millimeter, may be permissible in the machining process because the step can be covered with an oxidation coating. The oxidation coating may have a thickness of between about 0.15 and 0.25 millimeter.

The foregoing description is provided in the context of one possible application for the system and method according to aspects of the invention. While the above description is made in the context of casting a turbine blade, it will be understood that the system according to aspects of the invention can be readily applied to any hollow cast turbine engine component, especially those in which the wall thickness is critical. Moreover, it will be readily appreciated that aspects of the invention can be readily applied to components outside of turbine engine components. Thus, it will of course be understood that the invention is not limited to the specific details described herein, which are given by way of example only, and that various modifications and alterations are possible within the scope of the invention as defined in the following claims.

What is claimed is:

1. A component comprising: an outer wall having an outer surface and an inner surface, the inner and outer surfaces comprising respective contoured non-planar surfaces, the outer surface including a first outer inspection target surface, the first outer inspection target surface being substantially flat, the inner surface including a first inner inspection target surface, the first inner inspection target surface being substantially flat, the first outer inspection target surface and the first inner inspection target surface adjacently bounded by the respective non-planar surfaces, the first inner inspection target surface being substantially aligned with the first outer inspection target surface, the first outer inspection target surface being substantially parallel to the first inner inspection target surface, whereby an accurate measurement of the thickness of the outer wall can be obtained at the location of the aligned inner and outer inspection target surfaces.

2. The component of claim 1, wherein the component is an airfoil.

3. The component of claim 1, wherein the outer inspection target surface is defined by a portion of an innermost surface of a groove formed in the outer surface of the outer wall of the component.

4. The component of claim 3, wherein the groove includes opposing sidewalls, wherein the innermost surface of the groove is substantially perpendicular to at least one of the sidewalls.

5. The component of claim 3, wherein the groove includes opposing sidewalls, wherein the innermost surface of the groove is non-perpendicular to at least one of the sidewalls.

6. The component of claim 1, wherein the outer surface and the inner surface of the outer wall are contoured.

7. The component of claim 1, further including a second inner inspection target surface on the inner surface of the outer wall, wherein the second inner inspection target surface is spaced from the first inner inspection target surface.

8. The component of claim 7, wherein the second inner inspection target surface is aligned with the first outer inspection target surface, and wherein the first outer inspection target surface is substantially parallel to the second inner inspection target surface.

9. The component of claim 7, wherein the second inner inspection target surface is aligned with a second outer inspection target surface, and wherein the second outer inspection target surface is substantially parallel to the second inner inspection target surface.

10. The component of claim 7, wherein the second inner inspection target surface is different from the first inner inspection target surface in at least one of size and shape.

11. A component comprising:

a root;

an airfoil extending from the root toward a tip, the airfoil comprising an outer wall defining an airfoil shape;

the outer wall comprising a thickness that is in excess of a desired minimum thickness based on a stress load in the component during its use in a turbine engine; and a groove formed in a contoured, non-planar portion of an outer surface of the outer wall, the groove extending from the outer surface to a depth such that a remaining wall thickness of the outer wall from an innermost substantially flat bottom surface of the groove to an inner surface of the outer wall opposed the groove is the desired minimum thickness.

12. The component of claim 11, further comprising the groove being formed in a radially outer 50% of a distance from the root to the tip.

13. The component of claim 11, wherein the groove is a first groove and further comprising a second groove formed in the outer surface of the outer wall, the second groove formed to have a different orientation than the first groove.

14. The component of claim 13, wherein the first and second grooves form a crosshatched configuration.

15. The component of claim 11, wherein the desired minimum thickness varies between about one millimeter proximate the tip to between 2.3 and 2.8 millimeters at an intersection with a portion of the airfoil without a groove.

16. The component of claim 1, further comprising a substantially flat inner inspection target being formed on the inner surface of the outer wall aligned with the substantially flat bottom surface of the groove.

17. The component of claim 16, wherein the substantially flat bottom surface of the groove is parallel to the inner inspection target.

* * * * *